United States Patent [19]

Goetzinger

[11] 4,199,844

[45] Apr. 29, 1980

[54] METHOD AND MEANS FOR REGULATING SLIVER DRAFT UNIFORMITY

[75] Inventor: David J. Goetzinger, Greenville, S.C.

[73] Assignee: Platt Saco Lowell Limited, Helmshore, England

[21] Appl. No.: 899,778

[22] Filed: Apr. 25, 1978

[51] Int. Cl.[2] ..... D01H 5/42

[52] U.S. Cl. ..... 19/240; 57/81

[58] Field of Search ..... 307/149, 154; 57/81, 57/264, 265; 19/240, 241; 318/645

[56] References Cited

U.S. PATENT DOCUMENTS

| | | | |
|---|---|---|---|
| 2,812,553 | 11/1957 | Coulliette | 19/130 |
| 3,435,673 | 4/1969 | Felix | 73/160 |
| 3,673,591 | 1/1972 | Schwartz | 340/259 |
| 3,723,991 | 3/1973 | Schwartz | 340/259 |
| 3,744,093 | 7/1973 | Felix | 19/240 |
| 3,822,590 | 7/1974 | Tharpe | 73/160 |
| 3,829,751 | 8/1974 | Bottone | 318/645 |
| 3,869,759 | 3/1975 | Savageau | 19/293 |
| 3,992,865 | 11/1976 | Tuchida | 57/81 |
| 4,109,450 | 8/1978 | Yoshida | 57/81 |

OTHER PUBLICATIONS

Platt Saco Lowell Instruction Manual, 1st Edition, Versamatic Model DF Type 746, 7-77.

*Primary Examiner*—L. T. Hix
*Assistant Examiner*—S. D. Schneyer
*Attorney, Agent, or Firm*—Joseph H. Heard

[57] ABSTRACT

The draft imparted to sliver during regular operation of a sliver drafting apparatus is correctively varied in proportion to uniformity variations then detected in the sliver. During at least part of each period of start-up of the apparatus, the sliver is subjected to a prescribed correction draft approximately equal to an average of the draft corrections applied to the sliver over a relatively long time interval during the last-ensuing regular operation of the apparatus. During that initial part of each start-up period required for the apparatus to accelerate to substantially full operating speed, the prescribed correction draft is either not applied or, alternatively, is scaled in proportion to the speed of the apparatus. Preferably the correction draft applied to the sliver during transition from start-up to regular operation of the apparatus is approximately equal to the sum of the prescribed correction draft applied during the start-up period, and any additional correction draft resulting from uniformity variations then detected in the sliver.

20 Claims, 4 Drawing Figures

METHOD AND MEANS FOR REGULATING SLIVER DRAFT UNIFORMITY

BACKGROUND OF THE INVENTION

This invention relates to regulation of the uniformity of textile sliver drafted by sliver drafting apparatuses, and more specifically relates to regulation of the uniformity of the sliver drafted during certain of operation, including particularly periods of start-up, of the drafting apparatuses.

It is known to provide sliver drafting apparatuses with so-called "leveler" mechanisms adapted to detect variations in the uniformity of the sliver drafted by the apparatuses and to correctively vary the draft imparted to the sliver in proportion to the detected uniformity variations. One leveler mechanism of the aforesaid type is that heretofore manufactured and sold by Platt Saco Lowell Corporation and disclosed in its publication entitled "INSTRUCTION MANUAL VERSAMATIC® MODEL DF DRAWING FRAME." Other known prior art of possible relevance to the present invention includes U.S. Pat. Nos. 2,812,553, 3,435,673, 3,673,591, 3,744,093, 3,822,590 and 3,869,759.

Leveler mechanisms of the above-described type generally function quite well during regular operation of the drafting apparatuses with which they are associated. However, at least some do not function satisfactorily during periods of start-up of the apparatuses, due to then existing instability of the means they employ for detecting variations in the sliver uniformity. For example, the detecting means of the hereinbeforenoted leveler mechanism of Platt Saco Lowell Corporation, which utilizes pneumatic principals in its detection of sliver uniformity variations, stabilizes only after some four to five seconds of start-up operation of the drafting apparatus. Such a leveler mechanism may cause grossly improper changes in the draft imparted to the sliver during start-up of a drafting apparatus if permitted to then function. In recognition of the foregoing fact, it has heretofore been proposed to null the operation of the leveler mechanism during each period of start-up of the drafting apparatus. This solution to the problem is not entirely satisfactory. It affords no correction whatsoever of any uniformity variations present within the sliver drafted by the apparatus during each start-up period: At current production rates, over 100 feet of sliver may pass through the apparatus during each such five-second time period. An alternative solution which might at first impression appear feasible would be to subject the sliver drafted during apparatus start-up to the same correction draft as was being applied to the sliver at the time the apparatus was shut-down. However, this is also unsatisfactory. Shut-down of a drafting apparatus is commonly caused by one or more of the strands in the sliver array breaking, running-out, or lapping-up about a drafting roll of the apparatus. The leveler mechanism may detect the marked change in uniformity, resulting from the absence of one or more of the sliver strands, prior to the drafting apparatus being shut-down, either manually or by actuation of one of the stop-motion devices customarily associated with the drafting apparatus. In this situation the correction draft produced by the leveler mechanism at the time of shut-down will be of a large positive magnitude adapted to offset the grossly underweight condition of the sliver attributable to the incomplete nature of its array. While the drafting apparatus is shut-down, a machine attendant should and normally would restore the sliver array to its complete condition. Upon subsequently ensuing start-up of the apparatus, it would therefore be inappropriate and detrimental to apply to the restored array of sliver the same correction draft as was applied to the imcomplete sliver array at the time of shut-down of the apparatus: If done, this would cause the sliver processed by the apparatus during the period of start-up to be severely overweight.

The initial and terminal parts of each period of start-up of the drafting apparatus present still other considerations. For approximately the first second of each period of start-up thereof, the drafting apparatus is rapidly accelerating to full operating speed. If the leveler mechanism acheives draft correction by causing absolute-value changes in the speed of certain of the drafting rolls, a speed change of any given absolute value will not produce the same correction draft while the apparatus is accelerating as it would produce if the apparatus were operating at full speed. The terminal part of each period of start-up of the apparatus is significant since it is one of transition: The leveler mechanism, which during start-up has not been permitted to function in its normal manner, will now again do so. The resumption of normal operation of the leveler mechanism should preferably be effected, at this time of transition, in a way allowing the leveler mechanism to rapidly but smoothly apply to the sliver then passing through the drafting apparatus correction drafts proportional to whatever uniformity variations are actually present within such sliver.

OBJECTS OF THE INVENTION

With the foregoing in mind, the primary object of the present invention is to better regulate the uniformity of sliver drafted by a sliver drafting apparatus during start-up or comparable periods of operation thereof.

A more specific object is to provide a method and means by which sliver drafted by a drafting apparatus during start-up thereof is subjected to a prescribed correction draft adapted to enhance the uniformity of such sliver.

Another object is to so control the magnitude or time of application of the aforesaid estimated correction draft as to allow for the acceleration of the drafing apparatus which occurs during the first part of each period of start-up.

Still another object is to achieve a rapid yet smooth resumption, upon transition from start-up to regular operation of the drafting apparatus, of the application to the sliver of correction drafts proportional to uniformity variations actually present within the sliver.

SUMMARY OF THE INVENTION

In accordance with the present invention, the sliver drafted during certain periods of operation of a sliver drafting apparatus, including particular the periods of start-up of the apparatus, is subjected to a prescribed correction draft. The correction draft is based upon and approximately equal to an average of the relatively short-term correction drafts imparted to the sliver drafted over a relatively long time interval by the apparatus during its last-ensuing period of regular operation. The relatively long duration of the averaging time interval minimizes the effect of any averaged correction draft of unusually large magnitude which might have been applied only briefly to the sliver immediately prior to shut-down of the apparatus or, for that matter, at some other time during its last-ensuing regular operation.

When utilized during periods of start-up of the drafting apparatus, the aforesaid correction draft may be applied to the sliver only after expiration of the initial brief time interval, of approximately one second duration, required during each start-up period for the then-accelerating drafting apparatus to reach substantially full speed. In an alternative embodiment the correction draft is applied to the sliver during all of each period of start-up of the apparatus but is first "scaled" in proportion to the speed of the apparatus so as to produce an appropriate draft correction even during the initial time interval of acceleration of the apparatus.

In accordance with another aspect of the invention, the correction draft applied to the sliver during each transition from start-up to regular operation of the drafting apparatus is made to equal the sum of the prescribed correction draft applied to the sliver during the immediately-preceding start-up period, and the correction draft required to offset then-detected variations in the sliver uniformity. If during the final part of the start-up period a prescribed correction draft of, say, plus five is being applied to the sliver, and the uniformity variations then actually detected within the sliver would produce a correction draft of minus two, the correction draft applied to the sliver upon transition from start-up to regular operation of the apparatus is thus made to be plus three, as opposed to the minus two value which it otherwise have. Resumption of the regulation of the sliver uniformity in accordance with detected variations is thus effected smoothly and rapidly.

Still other features of the invention will be apparent from the following description of illustrative embodiments thereof, which should be read in conjunction with the accompanying drawings.

DESCRIPTION OF THE PREFERRED EMBODIMENTS

Figure 1:
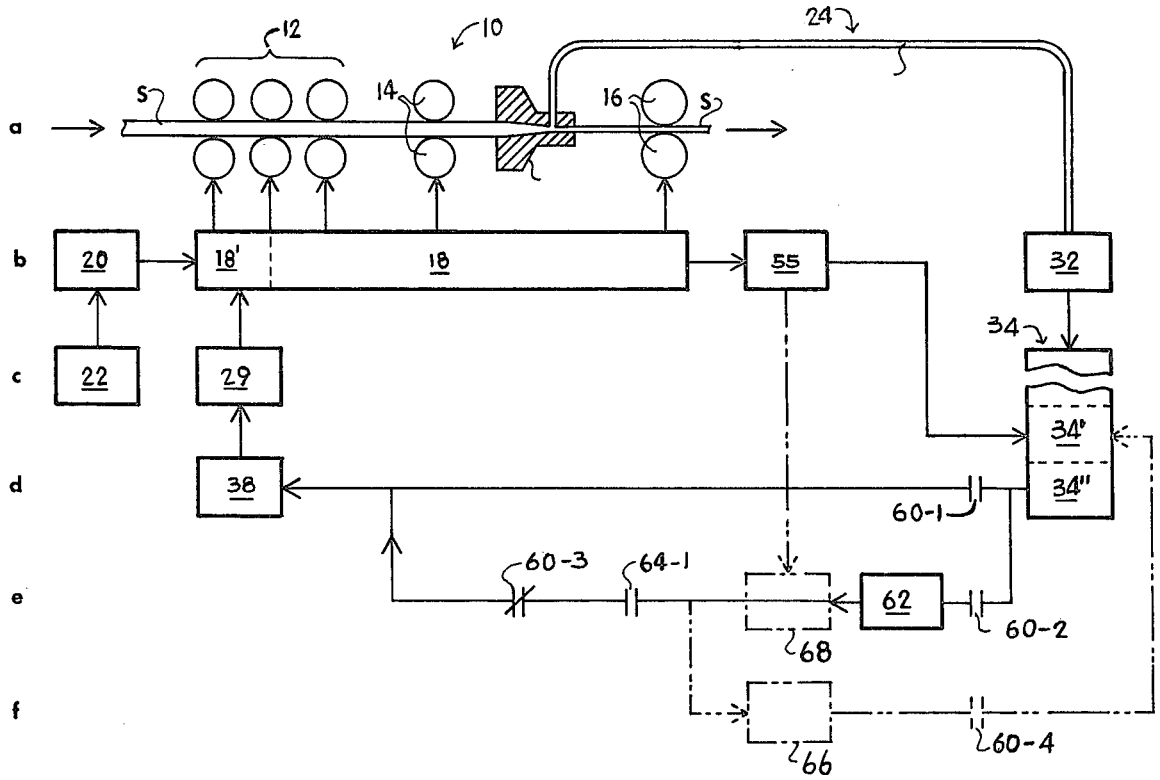
FIG. 1 is a schematic representation of a textile sliver drafting apparatus having associated therewith a leveling mechanism constructed and operable in accordance with the invention.

In FIG. 1 of the drawings, the numeral 10 generally designates a sliver drafting apparatus adapted to draft textile sliver S which passes through the apparatus, during operation thereof, in the left-to-right direction indicated by the directional arrows adjacent the sliver. Apparatus 10 includes sets of rotatable rear drafting rolls 12, front drafting rolls 14, and delivery rolls 16. The aforesaid rolls are all adapted to be driven by associated gearing mechanism 18 operatively connected, through a clutch member 20, to main drive motor 22 of apparatus 10. Front drafting rolls 14 and delivery rolls 16 are driven at equal speeds. The sets of rear drafting rolls 12 are driven at predetermined speed ratios relative to each other, and at speeds slower than the speed of front drafting rolls 14, so that a draft is imparted to sliver S within at least the drafting zone intermediate rolls 14 and the forwardmost set of rear rolls 12.

Apparatus 10 further includes a leveler mechanism, generally designated in FIG. 1 by the numeral 24, for detecting variations from a desired norm in the weight-uniformity of the sliver S processed by apparatus 10, and for correctively varying the draft imparted to sliver S by drafting rolls 12,14 of apparatus 10. In the illustrative form thereof shown in FIG. 1, the detecting means of leveler mechanism 24 includes a sliver-constricting trumpet member 26, through which sliver S passes during its travel between front drafting rolls 14 and delivery rolls 16. A conduit 28 communicates with trumpet 26 and is adapted to conduct from it pneumatic signal data representative of the quantities of air expulsed from sliver S, and thus indicative of the weight of the sliver, during its constrictive passage through trumpet 26. The draft varying means of leveler mechanism 24 illustratively includes a reversible and variable-speed servo motor 29 operatively connected to a control gear (not shown) of a planetary gear device 13' associated with that part of gear mechanism 18 which drives rear drafting rolls 12 of apparatus 10. The gearing arrangement is such that when servo motor 29 is not running, the draft imparted to sliver S in the drafting zone between rear drafting rolls 12 and front drafting rolls 14 is of the standard magnitude or value determined by the drive-input imparted to gearing mechanism 18 from main drive motor 22 of apparatus 10. Operation of servo motor 29 in either a first or second direction causes corresponding rotation of the control gear (not shown) of device 18', which in turn produces a corresponding increase or decrease, the magnitude of which is proportional to the speed of motor 29, in the speed of the rear drafting rolls 12. This in turn causes a proportional decrease or increase in the draft imparted to sliver S within the drafting zone forwardly of rolls 12. During regular operation of drafting apparatus 10, the operation of servo motor 29 is varied in accordance with any uniformity variations present within the sliver S passing through the previously-described trumpet 26. In the latter connection, the pneumatic signal data produced at trumpet 26 is transmitted through conduit 28 to a bridge transducer 32, which converts the data from pneumatic to electrical. In a subsequent signal-processing section 34 of the leveler mechanism circuitry, the foregoing AC electrical signal data undergoes amplification, conditioning and rectification, producing appropriate DC signal data which is then transmitted to a summing amplifier 34' of processing section 34. In order to eliminate signal variations which might be caused by changes in speed of apparatus 10, as opposed to changes in the uniformity of sliver S, summer 34' adds its aforesaid input with another DC signal input received by it from a tachometer 55 which senses and indicates the speed of operation of apparatus 10. The output voltage of summer 34' is preadjusted to be zero when there are no significant variations in the desired weight of the sliver S passing through trumpet 26. If the sliver weight varies, the inputs to summer 34' become unbalanced, and summer 34 produces output signal data which is proportional to the variations in the uniformity of the weight of the sliver S passing through trumpet 26. The final output signal data produced at line d of FIG. 1 by processing section 34 differs from the foregoing only in that the output of summer 34' has been further amplified and made somewhat more smooth. This is accomplished by an intergrating amplifier 34" of processing section 34. The signal-smoothing performed by integrator 34" affecs only those input-signal variations which are of very brief deviation, e.g., those whose duration is less than approximately 0.15 seconds. Any variation in the uniformity of sliver S having a length sufficient to produce an input-signal variation having at least the aforesaid very beief duration is therefore reflected in the output of integrator 34". During regular operation of drafting apparatus 10, the output signal data of processing section 34 is transmitted by line d of the FIG. 1 circuitry to an amplifier 38 which powers servo motor 29. The aforesaid signal data regulates the power output of amplifier 38 and thus regulates the correction draft imparted to sliver S by servo motor 29 via gearing 18 and rear drafting rolls 12.

The components of drafting apparatus 10 and leveler mechanism 24 which have been thus far described, and which are shown in lines a-d of FIG. 1, are conventional ones, being the same as employed in the hereinbefore mentioned drafting-apparatus leveler mechanism manufactured and sold by Platt Saco Lowell Corporation. Such prior-art leveler mechanism performs quite well during regular operation of drafting apparatus 10. However, it cannot be utilized during each period of start-up of apparatus 10, since the pneumatic signal data produced by its sliver uniformity detecting means is then unreliably erratic. Approximately four to five seconds of operation of drafting apparatus 10 are required for such signal data to stabilize and become reliable.

Figure 2:
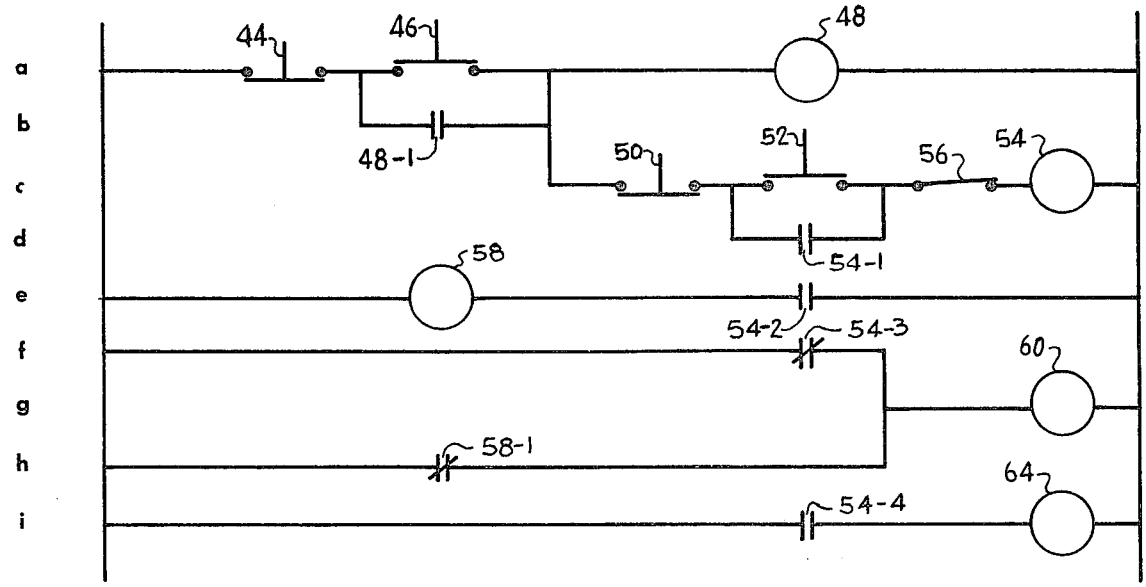
FIG. 2 is a schematic representation of additional control circuitry associated with components shown in FIG. 1.

In recognition of the foregoing fact, it has heretofore been the practice to provide nulling means in association with the basic control circuitry of the drafting apparatus serviced by the leveler mechanism, for nulling the operation of the leveler mechanism during each period (of approximately five seconds duration) of start-up of apparatus 10. Means which would have thus completely nulled the operation of the prior-art leveler mechanism, during each period of start-up of apparatus 10, include the relay contact 60-1 shown in line d of FIG. 1, and associated control components shown in lines a-h of the FIG. 2 basic control circuitry of apparatus 10. Referring now primarily to FIG. 2, the line a and b components control the operation of main drive motor 22 (FIG. 1) of apparatus 10, and consist of manually-operable stop and start switches 44, 46 respectively, and a main motor relay 48 having a holding contact 48-1. Main motor 22 (FIG. 1) of apparatus 10 commences operation in response to momentary actuation of switch 46, and continues in operation until actuation of stop switch 44. The components shown in lines c and d of FIG. 2 similarly control the operation of clutch 20 (FIG. 1) and include comparable manually-operated switches 50,52 and a clutch relay 54 having a holding contact 54-1. Assuming that main motor relay 48 (line a) is then energized, actuation of switch 52 and the resulting energization of relay 54 causes engagement of clutch 20 (FIG. 1) and thus places apparatus 10 into sliver-drafting operation. Operation of apparatus 10 continues until stop switch 44 (line a) or 50 is manually actuated or until a stop-motion switch 56 (line c) is automatically opened by one of the various stop-motion devices (not shown) normally associated with drafting apparatus 10. Switch 56 would be actuated, for instance, in response to a malfunction such as an end-down or roll lap-up, and/or in response to a "full" condition of the can (not shown) which receives the drafted sliver discharged by apparatus 10. Upon energization of clutch relay 54, closure of a second contact 54-2 (line e) thereof causes substantially simultaneous energization of a time delay relay 58. A normally-closed third contact 54-3 (line f) of clutch relay 54 is so asociated, along with normally closed contact 58-1 (line h) of time delay relay 58 (line e), with a relay 60 (line g) as to cause relay 60 to be energized whenever either contact 54-3 or 58-1 is closed. Relay 60 therefore continues to be energized, notwithstanding opening of contact 54-3 upon energization of clutch relay 54 (line c), until contact 58-1 opens in response to timing-out of relay 58. This occurs after a predetermined time interval, illustratively five seconds, of a duration sufficient for the pneumatic signal data of the leveler mechanism associated with drafting apparatus 10 to become stabilized. Upon deenergization of relay 60 at the expiration of the aforesaid start-up period of operation of apparatus 10, the ensuing closure of its contact 60-1 (FIG. 1, line d) causes transmission of thenstabilized signal data from processing section 34 to power amplifier 38 and thus causes the leveler mechanism to resume its previously-described regular operation. Drafting apparatus 10 remains in regular operation until any of the stop switches 44,50 or 56 at lines a or c of the FIG. 2 control circuitry are actuated. When this occurs the operation of the leveler mechanism is halted substantially contemperaneously with that of apparatus 10, since relay 60 (FIG. 2, line g) is again energized. Relay 60 continues to be energized during the time of shut-down of apparatus 10 and, when operation of apparatus 10 is re-commenced, during the then-occuring next one of the previously-described periods of start-up of the apparatus.

During each of the five-second periods of start-up of apparatus 10, approximately 100 feet of sliver S passes through the apparatus. The prior-art leveler mechanism, as previously described and as shown in lines a–d of FIG. 1 and lines a–h of FIG. 2, produces no corrections whatsoever of any nonuniformities present in such sliver. This obviously undesirable situation is obviated by the present invention, to be now described.

In accordance with the present invention the sliver S processed by apparatus 10 during each period of start-up of the apparatus is subjected, during all or at least a major part of each such period, to a prescribed draft correction. The prescribed draft correction is approximately equal to an average of the draft corrections produced by the leveler mechanism over a relatively long time interval during the last-ensuing regular operation of apparatus 10. The relatively large duration of the "averaging" time interval minimizes the effect of any of the "averaged" draft corrections produced by relatively short-term but unusually large-magnitude variations in the sliver uniformity. This minimization is particularly desirable when the averaging time interval encompasses the last second or so of regular operation of the drafting apparatus preceding a stop-motion induced shut-down thereof. There is considerable likelihood that such a shut-down of the apparatus may have been caused by an "end-down" or other temporary condition that was obviated after shut-down of the apparatus, and which therefore has little or no relevance to the uniformity of the sliver drafted during start-up of the apparatus.

The draft imparted to the sliver may be correctively varied as aforesaid during all of each period of start-up of the apparatus, including that initial brief part of the start-up period required for the apparatus to reach substantially full speed. This may be done by appropriate "scaling" of the prescribed correction draft, during at least the initial part of each start-up period, in accordance with and to compensate for the then-accelerating speed of the drafting apparatus. Alternatively, application of the prescribed correction draft during each period of start-up may be deferred until the drafting apparatus has reached substantially full speed.

In accordance with another aspect of the invention, the correction draft imparted to the sliver immediately after each period of start-up of the apparatus is made to be approximately equal to the sum of the prescribed correction draft imparted to the sliver during the immediately-preceding period of start-up of the apparatus, plus the draft correction which would have been then applied if predicated solely upon uniformity variations detected at the end of the start-up period within the sliver then undergoing processing.

All or various desired ones of the foregoing results may be achieved by means, to be now described, associated with the previously-described components of drafting apparatus 10 and its leveler mechanism 24. Such means includes firstly, a long-term integrator 62 (FIG. 1, line e) adapted during regular operation of apparatus 10 to also receive, on a "monitoring" basis, the signal data then transmitted to servo-motor power amplifier 38 (FIG. 1, line d) from signal processing section 34; and adapted, during each period of start-up of apparatus 10, to itself transmit signal data to power amplifier 38. Control of signal-data transmission to and from integrator 62 may be and illustratively is effected by additional contacts 60-2, 60-3 (FIG. 1, line e) and 54-4 (FIG. 2, line i) of previously-discussed relays 60 (FIG. 2, line g) and 54 (FIG. 2, line c) respectively; and by an additional time delay relay 64 (FIG. 2, line i) having a single contact 64-1 (FIG. 1, line e). Since during regular operation of apparatus 10 relay contacts 60-1 and 60-2 (FIG. 1, lines d and e) are both closed, the output signal data of processing section 34 is then transmitted to both power amplifier 38 and integrator 62. Such signal data is continuously integrated or averaged by integrator 62 over successive time intervals of a relatively large duration, for example 200–300 seconds, determined by the particular time-constant thereof. The output signal data produced at any given point in time by integrator 62 represents the integrated average of the last input signal data received by it over such time interval from processing section 34. In addition to having a relatively large time-constant, integrator 62 has a large bleed-down time. Following cessation of its receipt of input signal data, integrator 62 therefore continues to produce an output signal which is substantially the same as that produced by it at the moment of cessation of its input. During regular operation of drafting apparatus 10, the output of integrator 62 is not transmitted to power amplifier 38 due to the then-open condition of relay contact 60-3 (FIG. 1, line e).

When apparatus 10 is shut-down for any reason, the various relay contacts of the circuitry revert to the respective open or closed conditions thereof shown in FIGS. 1 and 2. No input is then received by integrator 62 since relay contact 60-2 is open. Although a data signal is then produced by integrator 62, it is not transmitted to power amplifier 38 while apparatus 10 is shut-down since contact 64-1 (FIG. 1, line e) of relay 64 is then open. In the latter connection, relay 64 (FIG. 2, line i) was deenergized at the time of shut-down of apparatus 10 in response to opening of relay 54-4 of clutch relay 54 (FIG. 2, line c).

During each period of start-up of apparatus 10, all of the relay contacts shown in FIG. 1 initially remain in their illustrated open or closed conditions. After approximately the first second of the start-up period, which first second is required for apparatus 10 to reach substantially full speed, contact 64-1 (FIG. 1, line e) closes in response to the timingout of time delay relay 64 (FIG. 2, line i), which was energized by closure of clutch relay contact 54-4 when operation of drafting apparatus 10 was re-commenced. Following closure of contact 64-1 (FIG. 1, line e) the data signal then still being produced by integrator 62 is transmitted to power amplifier 38, thus causing a proportional correction in the draft of the sliver S then being drafted by apparatus 10. This prescribed draft correction continues to be applied to the sliver S during all of the remaining four seconds or so of the start-up period and, as previously described, is approximately equal to the integrated average of the draft corrections which were applied to the sliver drafted by apparatus 10 during the final 200–300 seconds of its last-ensuing regular operation.

Upon expiration of the start-up period, the then-transpiring reversal of the illustrated conditions of each of the contacts of relay 60 closes the circuit connections by which signal data is transmitted from processing section 34 to amplifier 38 and to integrator 62, and opens the circuit connection between integrator 62 and amplifier 38.

Additional components, shown in phantom lines in FIG. 1, may be employed in association with those previously described. Thus, as is indicated at line f of FIG. 1, there may additionally be provided a feed-back circuit, incorporating a suitable signal-conditioning device 66 and another contact 60-4 of relay 60 (FIG. 2, line g), for transmitting to summer 34', during each period of start-up of apparatus 10, signal data which is representative of that then being produced by integrator 62. As a result of its conditioning by device 66, summer 34' can and does add such signal data to that which it is then also receiving, assuming the existence of variations in the uniformity of the sliver S then passing through trumpet 26, from the "upstream" components of signal processing section 34. The signal data produced by summer 34' during and, more importantly, immediately after each period of start-up of apparatus 10 is therefore equal to the sum of the aforesaid two imputs. This causes a correction draft of the proper magnitude to be applied immediately but nonabruptly to the sliver S being drafted by apparatus 10 during each transition from start-up to regular operation. Assume, for example, that during a particular period of start-up of apparatus 10 a prescribed correction draft of plus six is being applied to the sliver S processed by apparatus 10, as a result of the signal produced by integrator 62. Assume further that during the last part of such start-up period, the signal data resulting from then-transpiring detection of uniformity variations within the sliver indicates the need for a further draft correction of, say, plus two. The feed-back circuitry of line f of FIG. 1 causes a draft correction of the appropriate total value, plus eight, to be applied to sliver S at the moment of resumption of regular operation of apparatus 10. Without such feed-back circuitry, the immediately-applied correction draft would have a value of only plus two, and application to sliver S of the proper correction would be briefly delayed and would be accompanied by rather abrupt and contradictory fluctuations in the speed of servo motor 29 (FIG. 1, line c).

Another possible modification, indicated at line e of FIG. 1, consists in the provision of a scaling device 68 within the circuit branch through which an output signal from integrator 62 is transmitted to amplifier 38 during each period of start-up of apparatus 10. As indicated by the phantom-line extending between such components in FIG. 1, scaling device 68 also receives an input from tachometer 55. As a result of this arrangement, the output signal produced by integrator 62 is "scaled" or proportioned, prior to its transmission to amplifier 38, in accordance with the speed of drafting apparatus 10. Scaling device 68 permits the output of integrator 62 to be properly utilized by amplifier 38 during all of each period of start-up of apparatus 10, including that initial part during which the apparatus 10 is accelerating to substantially full speed. Therefore, when scaling device 68 is incorporated as shown into the circuitry, time delay relay 64 (FIG. 2, line i) and its contact 64-1 (FIG. 1, line e) need not be used and may be eliminated entirely from the circuitry.

Figure 3:
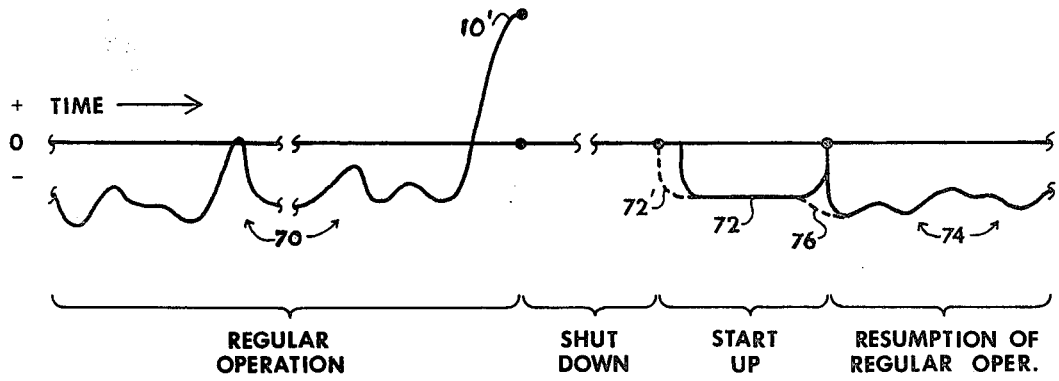
FIG. 3 is graphic representation of correction drafts such as might be applied to sliver, during different time periods, in accordance with the invention.

FIG. 3 schematically illustrates, in graphic form, draft corrections as might be applied to a sliver S by the leveler mechanism 24 constructed and operated in accordance with the present invention. Referring to FIG. 3, the illustrated first time period of regular operation of drafting apparatus 10 (FIG. 1) is that of the relatively large duration, preferably in the range of approximately 200–300 seconds, corresponding to the time-constant of integrator 62 (FIG. 1). During this indicated period of regular operation the applied correction drafts 70 vary in proportion to the uniformity variations detected in sliver S during its passage through trumpet 26 (FIG. 1). In the illustration of FIG. 3, sliver S has generally been "heavy" or overweight, and the applied correction drafts have therefore mostly been "negative" ones effective to appropriately decrease the speed of rear drafting rolls 12 (FIG. 1) and therefore increase the draft imparted to the sliver S between such rolls and front drafting rolls 14 (FIG. 1). However, immediately prior to shut-down of the drafting apparatus, a large positive correction draft 70′ was applied to sliver S, in response to the detection of a correspondingly-large underweight condition of the sliver S passing through trumpet 26. This condition might result, for instance, from breakage of one or more of the individual strands of the array of sliver S. Assuming such to be the case, the period of shut-down would be utilized by an attendant to restore the complete array of sliver S. Of course, while appaaratus 10 is shut-down, no sliver is being drafted and no correction draft is being applied. The prescribed correction draft 72 applied to sliver S during the illustrated period of start-up approximately equals the average of the illustrated correction drafts 70 applied to the sliver during the last-ensuing regular operation of apparatus 10, and therefore reflects the predominantly "negative" nature of the latter. The relatively long duration of the averaging time interval minimizes the effect of any of the averaged correction drafts, such as that illustrated one 70′ transpiring immediately prior to shut-down of apparatus 10, which are of unusually large magnitude but relatively small duration. The solid-line representation of the prescribed correction draft 72 denotes its application to sliver S during all of the start-up period except for the initial part thereof, of approximately one second duration, required for apparatus 10 to reach substantially full speed. As is indicated by the dash-line 72′, the correction draft may also be applied during the initial part of the start-up period if the output of integrator 62 (FIG. 1) is proportionally scaled by device 68 (FIG. 1, line e) in relation to the speed of apparatus 10. Upon resumption of regular operation of apparatus 10, the correction drafts 74 applied to sliver S are once again varied in proportion to detected variations in the uniformity of the sliver passing through trumpet 26 (FIG. 1). Dash-line 76 indicates the further improvement realizable, during transition from start-up to regular operation of apparatus 10, from utilization in the leveler mechanism of the optional circuitry shown at line f of FIG. 1, which during the start-up period feeds back to summer 34′ signal data representative of the prescribed correction draft then being applied to the sliver.

Figure 4:
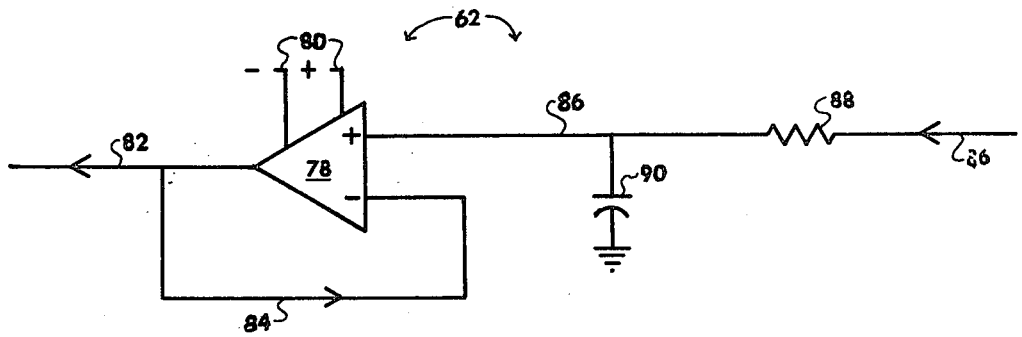
FIG. 4 is a somewhat more detailed but still schematic representation of one component shown in block form in FIG. 1.

FIG. 4 shows in somewhat greater detail the conventional equivalent circuitry of the long-term integrator 62 illustrated in block form in FIG. 1. As shown in FIG. 4, integrator 78 consists of an operational amplifier 78 having power input leads 80 and a signal output lead 82. One of the signal inputs to amplifier 78 is via an internal feed-back circuit 84 from output lead 82. The other signal input to amplifier 62 is via a lead 86, through which signal data from processing section 34 (FIG. 1) is transmitted, having associated therewith a resistance 88 and a capacitor 90, the latter requiring a relatively long time interval to both charge and discharge. Resistance 88 and capacitor 90 perform the data integrating and, in effect, "storage" functions of integrator 62. Amplifier 78, by reason of its having a independent power supply, enables the integrated and "stored" signal data to be extracted from capacitor 90 over relatively long periods of time with only minimal changes in value.

The invention has been shown and described in relation to first and second respective periods of "regular" and "start-up" operation of a drafting apparatus. However, it will be apparent that with only minor modifications of the control circuitry, the hereinbefore-described prescribed correction draft might be utilized during any second periods of operation of the drafting apparatus when, for whatever reason, it is not desired to correctively vary the sliver draft in accordance with uniformity variations then actually or apparently (insofar as the signal data of the uniformity detecting means is concerned) within the sliver. Therefore, while specific embodiments of the invention have been shown and described, it is to be understood that this was for purposes of illustration only, and not for purposes of limitation, the scope of the invention being in accordance with the following claims.

That which is claimed is:

1. A method of regulating the uniformity of textile sliver drafted by a sliver drafting apparatus during periods of start-up and regular operation of the apparatus, comprising:

detecting uniformity variations of the sliver drafted by the apparatus during regular operation thereof;

applying to the sliver, during regular operation of the apparatus, correction drafts proportional to the variations then detected in the uniformity of the sliver;

and applying to the sliver, during start-up of the apparatus, a prescribed correction draft approximately equal to an average of correction drafts applied to the sliver over a relatively long time interval during the last-ensuing regular operation of the apparatus.

2. A method as in claim 1, and further including the step of, during at least the initial part of the period of start-up of the apparatus, scaling the prescribed correction draft in proportion to the speed of the apparatus before application thereof to the sliver.

3. A method as in claim 1, and further including deferring application of the prescribed correction draft to the sliver during such initial part of the start-up period as is required for the apparatus to reach substantially full speed.

4. A method as in claim 1, including successively deriving averages of the correction drafts imparted to the sliver over successive time intervals during regular operation of the apparatus; and utilizing, as the prescribed correction draft applied to the sliver during start-up of the apparatus, the last one of the successively derived averages.

5. A method as in claim 1, and further including applying to the sliver, during transition from start-up to regular operation of the apparatus, an additive correction draft approximately equal to the sum of the prescribed correction draft applied to the sliver during the period of start-up and any additional correction draft required to compensate for then-detected variations in the uniformity of the sliver.

6. In combination with a textile sliver drafting apparatus, an improved leveler mechanism for regulating the uniformity of sliver drafted by said apparatus during periods of start-up and regular operation thereof, comprising:

detecting means for detecting uniformity variations in the sliver drafted by the apparatus during regular operation thereof;

first draft-correcting means for applying to the sliver, during regular operation of said apparatus, correction drafts proportional to variations then detected by said detecting means in the uniformity of the sliver;

and second draft-correcting means for applying to the sliver, during start-up of said apparatus, a prescribed correction draft approximately equal to an average of draft corrections applied to the sliver over a relatively long time interval during the last-ensuing regular operation of said apparatus.

7. Apparatus as in claim 6, and further including scaling means for, during at least the initial part of the start-up period of said apparatus, scaling the prescribed correction draft in proportion to the speed of said apparatus before the application thereof to the sliver.

8. Apparatus as in claim 6, and further including means for deferring application of the prescribed correction draft to the sliver during such initial part of the start-up period as is required for said apparatus to reach substantially full speed.

9. Apparatus as in claim 6, wherein said second means includes integrator means for successively deriving averages of the correction drafts imparted to the sliver over successive time intervals during regular operation of said apparatus; and wherein the prescribed correction draft applied by said second means to the sliver during start-up of the apparatus is the last one of the average correction drafts successively derived by said integrator means.

10. Apparatus as in claim 6, and further including summing means for causing application to the sliver, during transition from start-up to regular operation of said apparatus, of a correction draft approximately equal to the sum of the prescribed correction draft applied to the sliver during the period of start-up and any additional correction draft required to compensate for then-detected variations in the uniformity of the sliver.

11. In combination with a textile sliver drafting apparatus, an improved leveler mechanism for regulating the uniformity of sliver drafted by said apparatus during periods of start-up and regular operation thereof, comprising:

draft varying means for varying the draft of sliver processed by said apparatus in response to and in accordance with signal data transmitted thereto;

detecting means for detecting variations in the uniformity of the sliver processed by said apparatus;

first signal-producing means operatively associated with said detecting means for producing signal data, adapted to be transmitted to said draft varying means during regular operation of said apparatus, proportional to the uniformity variations then detected in the sliver processed by said apparatus;

second signal-producing means for monitoring and averaging signal data produced by said first means during regular operation of said apparatus, and for producing signal data representing an approximate average of the signal data last produced by said first means over a relatively long time interval during regular operation of said apparatus;

and circuit means for during regular operation of said apparatus transmitting to said draft varying means the signal data then produced by said first means, and for transmitting to said draft varying means during start-up of said apparatus the signal data then produced by said second means.

12. Apparatus as in claim 11, and further including scaling means for scaling the signal data transmitted to said draft varying means during start-up of said apparatus in proportion to the speed of said apparatus.

13. Apparatus as in claim 11, and further including summing means associated with said first signal-producing means for during start-up of said apparatus receiving inputs from said detecting means and from said second signal-producing means, and for causing the signal data produced by said first means during transition from start-up to regular operation of said apparatus to be approximately equal to the sum of said inputs.

14. Apparatus as in claim 11, wherein said circuit means includes means for deferring transmission of signal data from said second means to said draft varying means during such initial part of the period of start-up as is required for said apparatus to reach substantially full speed.

15. A method of regulating the uniformity of textile sliver drafted by a sliver drafting apparatus, comprising:

detecting relatively short-term uniformity variations of the sliver drafted by the apparatus during operation thereof;

applying to the sliver, during a first period of operation of the apparatus, correction drafts proportional to the relatively short-term variations then detected in the uniformity of the sliver;

and applying to the sliver, during a second period of operation of the apparatus, a prescribed correction draft approximately equal to an average of correction drafts applied to the sliver over a relatively long time interval during the last-ensuing first period of operation of the apparatus.

16. In combination with a textile sliver drafting apparatus, an improved leveler mechanism for regulating the uniformity of sliver drafted by said apparatus during first and second periods of operation thereof, comprising:

detecting means for detecting relatively short-term uniformity variations of the sliver drafted by said apparatus during operation thereof;

first means for applying to the sliver, during a first period of operation of said apparatus, correction drafts proportional to the relatively short-term variations then detected by said detecting means in the sliver uniformity;

and second means for applying to the sliver, during a second period of operation of said apparatus, a prescribed correction draft approximately equal to an average of correction drafts applied to the sliver over a relatively long-time interval during the last-ensuing first period of operation of said apparatus.

17. A method as in claim 15, including successively deriving averages of the correction drafts imparted to the sliver over successive time intervals during the first period of operation of the apparatus; and utilizing, as the prescribed correction draft applied to the sliver during the second period of operation of the apparatus, the last one of the successively derived averages.

18. A method as in claim 15, and further including applying to the sliver, during transition from the second to the first period of operation of the apparatus, an additive correction draft approximately equal to the sum of the prescribed correction draft applied to the sliver during the second period of operation and any additional correction draft required to compensate for then-detected variations in the uniformity of the sliver.

19. Apparatus as in claim 16, wherein said second means includes integrator means for successively deriving averages of the correction drafts imparted to the sliver over successive time intervals during said first period of operation of said apparatus; and wherein the prescribed correction draft applied by second means to the sliver during said second period of operation of said apparatus is the last one of the average correction drafts successively derived by said integrator means.

20. Apparatus as in claim 16, and further including summing means for causing application to the sliver, during transition from said second to said first period of operation of said apparatus, of a correction draft approximately equal to the sum of the prescribed correction draft applied to the sliver during said second period of operation and any additional correction draft required to compensate for then-detected variations in the uniformity of the sliver.

* * * * *